US010053852B2

(12) United States Patent
Veldhuizen et al.

(10) Patent No.: US 10,053,852 B2
(45) Date of Patent: Aug. 21, 2018

(54) METHOD FOR TEMPORARILY CLOSING OFF A GUTTER BEING COVERED BY A GRATE OF A PAVED PART OF THE EARTH'S SURFACE; AS WELL AS A CLOSING ORGAN FOR A GUTTER

(71) Applicant: Dennis Veldhuizen, Wilnis (NL)

(72) Inventors: Dennis Veldhuizen, Wilnis (NL); Martin Robert Drienhuizen, Loosdrecht (NL)

(73) Assignee: Dennis Veldhuizen, Wilnis (NL)

( * ) Notice: Subject to any disclaimer, the term of this patent is extended or adjusted under 35 U.S.C. 154(b) by 92 days.

(21) Appl. No.: 14/902,644

(22) PCT Filed: Jul. 9, 2014

(86) PCT No.: PCT/NL2014/050466

§ 371 (c)(1),
(2) Date: Jan. 4, 2016

(87) PCT Pub. No.: WO2015/005784

PCT Pub. Date: Jan. 15, 2015

(65) Prior Publication Data

US 2016/0168839 A1 Jun. 16, 2016

(30) Foreign Application Priority Data

Jul. 10, 2013 (NL) ..... 2011130

(51) Int. Cl.

| | |
|---|---|
| ***E03F 5/04*** | (2006.01) |
| ***E03F 5/06*** | (2006.01) |
| ***E03F 3/04*** | (2006.01) |

(52) U.S. Cl.
CPC ..... *E03F 5/0411* (2013.01); *E03F 3/046* (2013.01); *E03F 5/0401* (2013.01); *E03F 5/06* (2013.01); *E03F 2201/10* (2013.01)

(58) Field of Classification Search
CPC ..... E03F 5/0411; E03F 5/0401; E03F 5/06; E03F 3/046; E03F 2201/10
See application file for complete search history.

(56) References Cited

U.S. PATENT DOCUMENTS 1,720,444 A * 7/1929 Rowley ..... F16K 15/03 137/527.8
2,587,358 A * 2/1952 McRae ..... F16K 15/03 137/463

(Continued)

FOREIGN PATENT DOCUMENTS

| | | |
|---|---|---|
| DE | 30 46 386 A1 | 7/1982 |
| DE | 197 57 743 C1 | 2/1999 |
| JP | 2000-345608 A1 | 12/2000 |

*Primary Examiner* — Abigail Anne Risic
(74) *Attorney, Agent, or Firm* — Shewchuk IP Services, LLC; Jeffrey D. Shewchuk

(57) ABSTRACT

A grate (111)-covered gutter (110) of a paved part of the earth's surface (100) is temporarily closed off by means of a closing organ (130), the gutter (110) being connected to a sewage pipe (120). Thus, the draining away of contaminating liquid can be prevented. The closing organ (130) includes a valve (131 fitted rotatably in the gutter (110). The valve (131) can be in a first stable position wherein the valve (131) seals. The valve can also be in a second stable position in which the valve (131) releases the gutter (110) for the discharge of liquid (rainwater) to the sewage pipe.

16 Claims, 3 Drawing Sheets

(56) References Cited

U.S. PATENT DOCUMENTS

Figure 1:
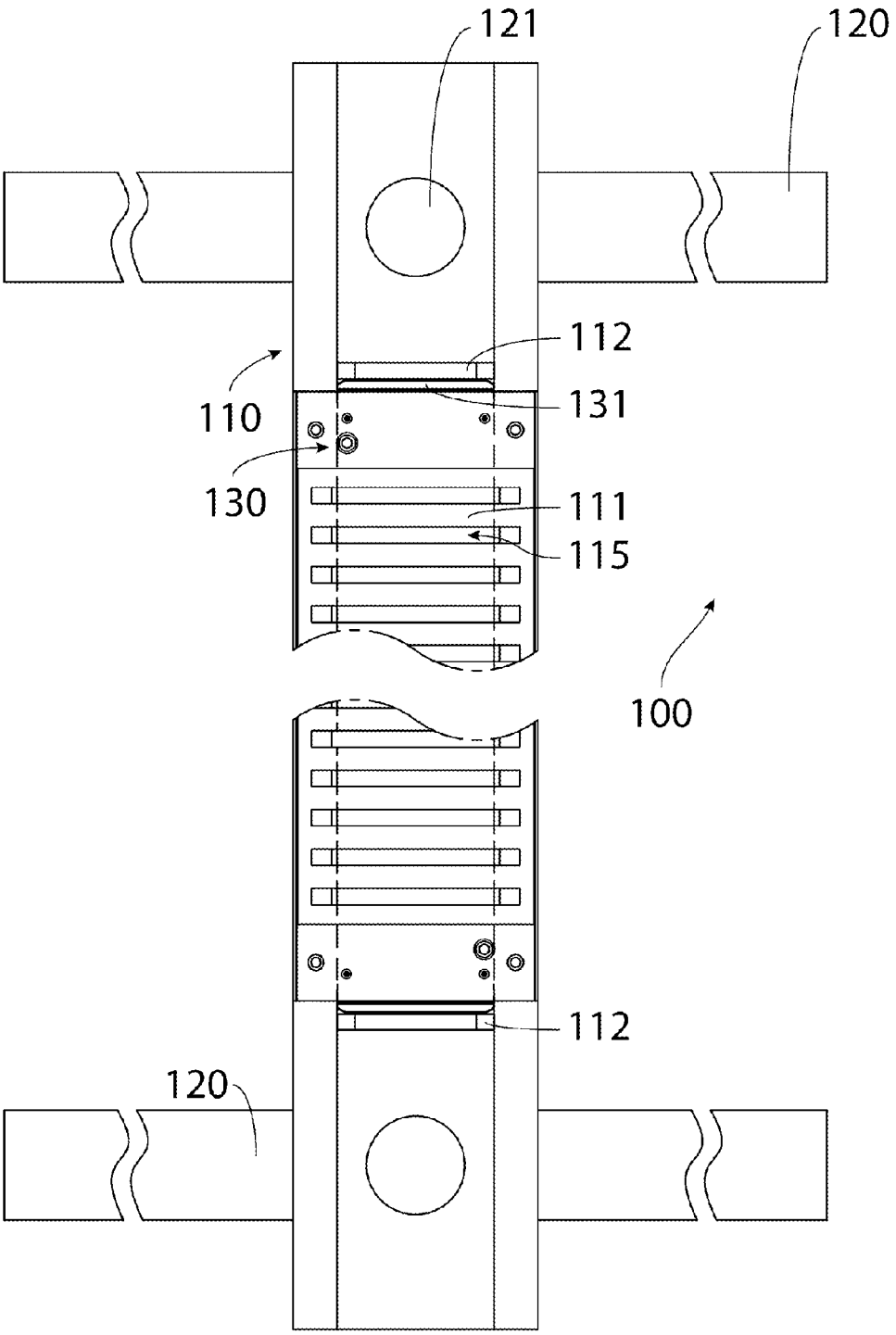

| | | | | |
|---|---|---|---|---|
| 2,882,923 | A * | 4/1959 | Smolensky | E03F 7/04 137/515.5 |
| 4,936,350 | A * | 6/1990 | Huber | E03F 7/02 137/68.19 |
| 5,232,587 | A * | 8/1993 | Hegemier | B01D 29/111 210/162 |
| 5,582,720 | A * | 12/1996 | Deming | E02D 29/14 210/164 |
| 5,728,294 | A | 3/1998 | Deming | |
| 6,743,354 | B1 * | 6/2004 | Evans, Jr. | E03F 1/00 210/164 |
| 6,972,088 | B2 * | 12/2005 | Yehuda | E03F 1/00 210/156 |
| 7,101,114 | B1 * | 9/2006 | Waters, Jr. | E02D 29/1436 405/39 |
| 7,662,280 | B1 | 2/2010 | Cooney | |
| 2008/0060986 | A1 * | 3/2008 | Lee | E03F 1/00 210/170.03 |
| 2015/0101971 | A1 * | 4/2015 | Jarvis | E03F 5/0404 210/154 |

* cited by examiner

METHOD FOR TEMPORARILY CLOSING OFF A GUTTER BEING COVERED BY A GRATE OF A PAVED PART OF THE EARTH'S SURFACE; AS WELL AS A CLOSING ORGAN FOR A GUTTER

The present invention relates to a method for temporarily closing off a grate-covered gutter, of a paved part of the earth's surface by means of a closing organ, said gutter being connected to a sewage pipe.

When it rains, rain will accumulate on a paved piece of the earth's surface, such as the area at the gates of an airport. This rainwater is discharged via discharge gutters into the sewer. In case of leakage of fuel such as kerosene or in case of de-icing liquid for de-icing an aircraft, such contaminating liquids should not end up in the sewer.

In order to avoid this, it is known to place one or more closing organs in the gutter. Hereby within the gutter a gutter section is formed that is not in liquid-connection with the sewer. Thus, the contaminating liquid cannot flow into the sewer. The contaminating liquid is pumped out of the gutter and for instance conveyed by means of a tank truck for environmentally responsible processing of the contaminating liquid. More specifically, it is known to provide a gutter of a paved piece of the earth's surface with a plate-shaped closing organ, which plate-shaped closing organ is introduced in a slot transverse to the gutter for closing off the gutter.

A problem is that placing the plate-shaped closing organs may take a lot of time. Another problem is that in case of a leakage of fuel, an unplanned event, the closing off may take up so much time that the contaminating liquid has already at least partially ended up in the sewer before the plate-shaped closing organs have been put into position.

The object of the present invention is to provide a method according to the preamble with which at least one of these problems is reduced.

To this end, a method according to the preamble is characterized in that the gutter comprises a closing organ comprising a valve, which valve is fitted in the gutter rotatably about an axis of rotation of a valve axle, wherein the valve can be in a first stable position wherein the valve seals against a seat, and in a second stable position in which the valve releases the gutter for the discharge of liquid to the sewage pipe, wherein the closing organ is arranged for bringing the valve from the second stable position to the first stable position by rotating about the axis of rotation of the valve axle in order to counteract draining away of liquid from the gutter into the sewage pipe, and the valve is brought in the sealing first stable position.

With the method of the invention the closing organ is already at the location where it is needed: In the gutter. Therefore there is no need to separately store the closing organ until use. This saves storing space. More importantly, no time is lost anymore by having to pick up the closing organs from a storage facility. These are already on site and merely need to be brought into the sealing first stable position. In practice this will be done on site on the paved piece of the earth's surface. The closing organ is located between two sewage discharge openings or between a dead (blind) end of the gutter and a sewage pipe. In the first case there will be two closing organs. In each of these two cases a section of the gutter can be closed off, i.e. it can be prevented that liquid flows from the gutter section into the sewage pipe. With the method of the invention by using a plurality of closing organs in a gutter, it is possible to close off the gutter only at the location where the contamination is taking place. This will restrict the amount of contaminating liquid that has to be pumped out of the gutter and has to be processed, which will result in a considerable saving of cost. This is also an important advantage over a method wherein the access opening of the sewage pipe into which the gutter discharges is carried out sealably. In the application the term "paved piece of the earth's surface" comprises a car park, a plot at a company for storage and/or carrying out services, a plot for stationing aircrafts, a gas station, a runway and a road. The paving will in general be substantially impermeable for liquid and is for instance formed by cast concrete, cast asphalt and optionally butted up plate-shaped elements such as concrete slabs. The latter will have a size have of at least 1×1 m. In the art, the gutter covered with a grate is designated line gutter or grate gutter. In the present application the term "stable position" means that this position is maintained passively, i.e. without the need of energization by an actuator. This may for instance be achieved by using friction and/or locking. By default the valve of the closing organ according to the invention will be in the second stable position for discharging liquid (rainwater) to the sewer. In case of a calamity or an activity at which contaminating liquid ends up or may end up in the gutter, the valve will be brought in the first stable position. This may be done by an operator, for instance by operating an operating organ for changing the position of the valve.

According to a favourable embodiment, the closing organ comprises an adjustment organ, which adjustment organ comprises an operating organ and the valve is brought from the second stable position to the first stable position by operating the operating organ.

Thus, the valve can be effectively operated.

According to a favourable embodiment, the adjustment organ comprises a transmission wherein a relatively large rotation about an operating organ axis causes a relatively small rotation of the valve around the valve axle.

Thus, the reliability of the valve remaining in a selected stable position is increased. In this way, a higher level of friction can be chosen for maintaining a stable position, while the valve can still be operated well because of the transmission. Furthermore, a transmission makes it possible to change the position of the valve using less force. Advantageously, the operating organ axis is the axis of rotation of a worm wheel part of the adjustment organ, which worm wheel engages a gear of which the axis of rotation runs parallel with, such as coincides with, that of the valve axle. The gear may also be part of the adjustment organ. The valve axle may be connected with the gear by keys, which technique is commonly known.

According to a favourable embodiment, an end of the operating organ axis is at a distance from the bottom of the gutter and can be accessed from the paved piece of the earth's surface without removing a grate for rotating the operating organ, wherein the end of the operating organ is rotated through which the valve is brought from the second stable position to the first stable position.

Thus, the valve can be closed and a closed off gutter section can be formed very easily and quickly. To this end the closing organ may have a supporting surface with a hole which the end of the operating organ axis can be operated.

According to a favourable embodiment, the valve axle is rotatable transverse to the vertical for bringing the closing organ from the second stable position to the first stable position, which valve axle is situated at a location that is away from the bottom of the gutter.

Thus, in the second stable position of the closing organ the discharge of rainwater to the sewer can take place without hindrance.

According to a favourable embodiment, the closing organ has a locking organ with which the valve is maintained in the second stable position before being brought to the first stable position.

Thus, it can be ascertained that rainwater can be discharged without hindrance.

According to a favourable embodiment, the closing organ comprises a locking organ that comprises a ring with recesses and an element that, for locking, is pressed in a recess of the ring by means of a spring and at a relative rotation of the element with respect to the ring exits the recess by pressing the spring.

Such locking is very reliable since it is not based on sheer friction. The element is for instance a ball.

According to an especially preferred embodiment, the locking organ comprises a slack adjuster for a brake.

Slack adjusters are known from trucks. With a slack adjuster the valve can be held at choice in the first stable position or the second stable position in a very reliable manner. Changing the stable position can also be done during tough weather conditions, such as frosts. The slack adjuster will in practice be a commercially available slack adjuster that has been modified, in particular by the removal of one or more unnecessary parts thereof, more specifically a fastening arm.

According to a favourable embodiment, the valve has a first side and a second side, wherein the first side in the first stable position seals against the seat and the second side is provided with a colour for being able to observe through the grate of the gutter that the closing organ is in the second position.

Thus, for a paved piece of the earth's surface, which may be very large, it can be easily checked whether the valves are in the desired position. An airport may even have for instance 200 or more of such closing organs with valves. The inspection can optionally be done without having to leave the vehicle commonly used at an airport.

According to a favourable embodiment, the closing organ comprises a frame, wherein the frame comprises a supporting surface that faces the sky and the valve is below the supporting surface both in the first stable position and in the second stable position.

The supporting surface can be walked or driven on. The supporting surface is for instance provided in the shape of a plate, and the supporting surface may have one or more openings for access to for instance the operating organ or fastening means with which the closing organ can be fixed to the paved piece of the earth's surface.

According to a favourable embodiment, contaminating liquid collected in a closed off gutter section of the gutter is pumped out of the gutter section.

This contaminating liquid will then not end up in the sewer and can be processed in a responsible way. After pumping out the closed off gutter section (115) the valve will be brought in the second stable position again.

Finally, the present invention relates to closing organ for a gutter, wherein the closing organ comprises a frame and a valve, wherein the frame comprises a supporting surface that faces the sky in the installed state of the closing organ;

the valve is rotatable about an axis of rotation of a valve axle, wherein the valve can be in a first stable position for allowing sealing of the valve against a seat, and in a second stable position in which the valve does not seal against the seat, wherein the closing organ is arranged for bringing the valve from the second stable position to the first stable position by rotating about the axis of rotation of the valve axle.

Such a closing organ is suitable for use with the method of the invention. The supporting surface can be walked or driven on. The supporting surface may have one or more openings for access to an operating organ or fastening means with which the closing organ can be fixed to the paved piece of the earth's surface. The invention also relates to all variants of the closing organ such as discussed for the method claims in each combination thereof, wherein this reference merely serves to avoid repetition.

According to a favourable embodiment, the closing organ comprises a seat.

The seat may be an integral part of the closing organ. In that case, for use of the closing organ with the method of the invention the seat will be installed in the gutter by means of for instance a sealing rubber and/or sealing kit such as silicone kit.

Figures 2A, 2B, 2C:
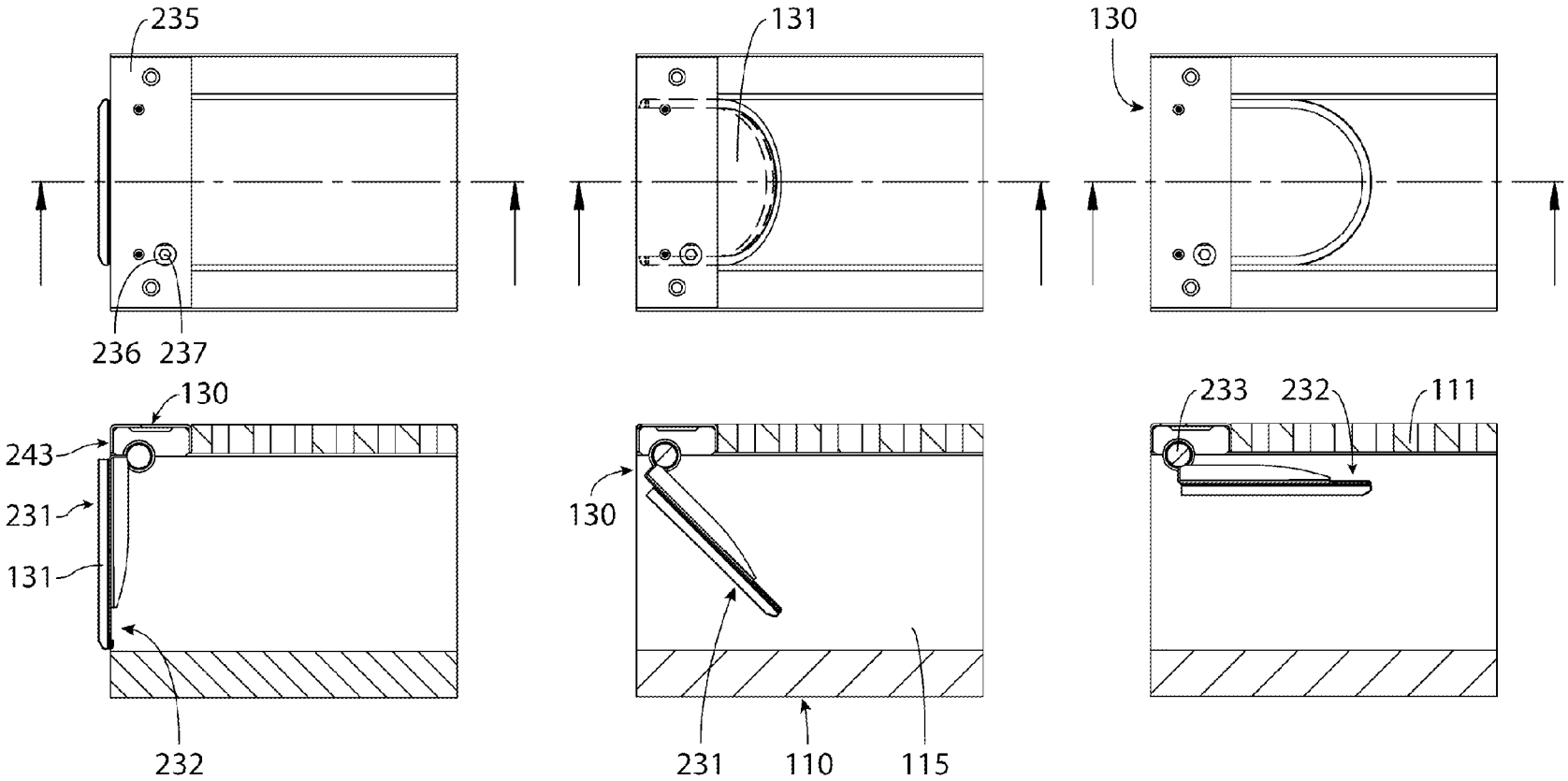
Figure 3B:
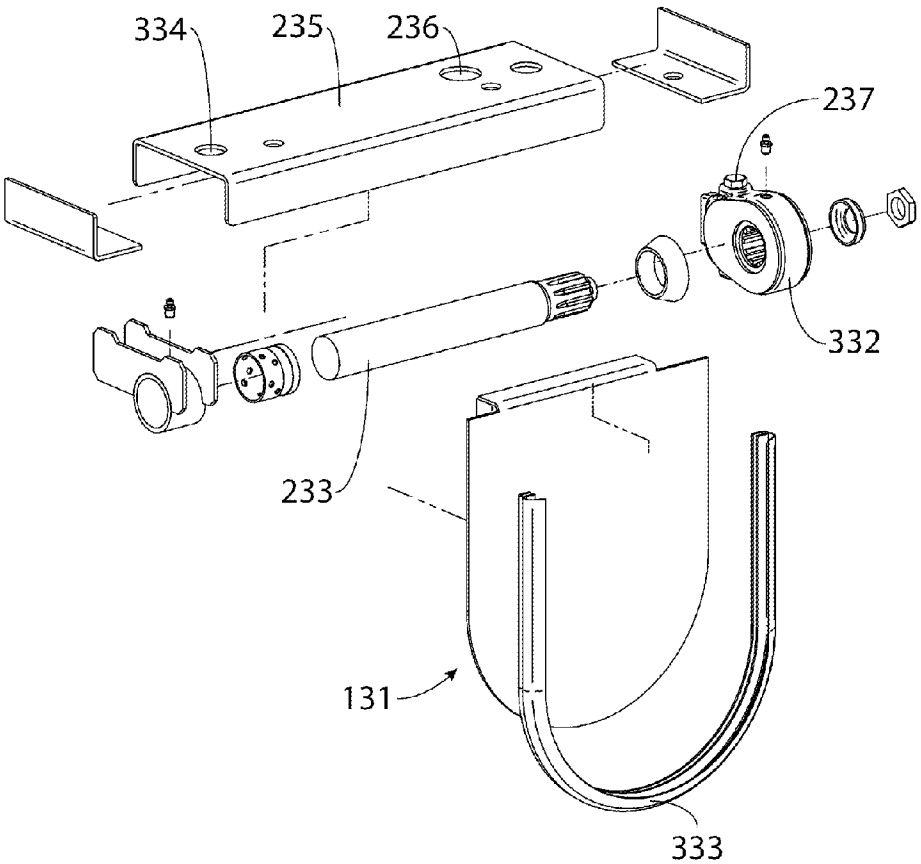
Figure 3A:
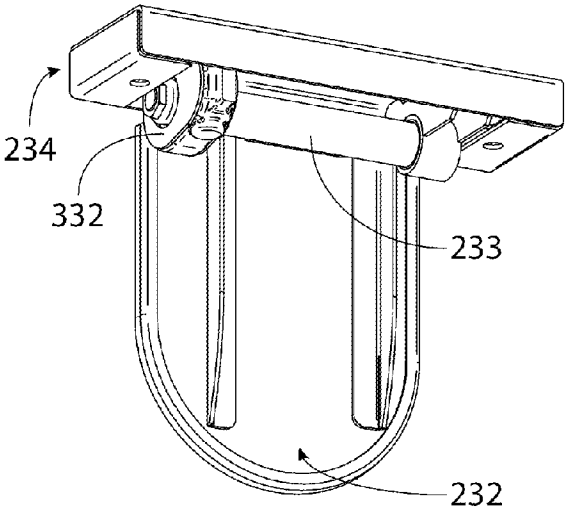

The present invention will now be illustrated with reference to the drawing where FIG. 1 shows a partly cut away top view of a platform that comprises a gutter;

FIG. 2*a-c* show a closing organ in a gutter in three positions, in top view and cross-section respectively; and FIGS. 3*a* and 3*b* show a closing organ in a perspective view and in an exploded sectional view respectively.

FIG. 1 shows a platform 100 which comprises a gutter 110 that is connected to a sewage pipe 120. The platform 100 is a paved piece of the earth's surface, for instance a concrete section of an airport. The gutter 110 is covered with a grate 111 for letting through rainwater which is discharged via the gutter 110 to the sewage pipe 120, via sewage pipe opening 121 into the sewage pipe 120.

In order to prevent contaminating liquid, such as kerosene or de-icing liquid at airports, from ending up in the sewage pipe 120, the gutter 110 is provided with a closing organ 130 near the sewage pipe opening 121. The closing organ 130 comprises a valve 131 which closes in a sealing position against a seat 112 of the gutter 110. Between the closing organs 130 a gutter section 115 is then formed which can be pumped out for the removal therefrom of contaminating liquid.

FIG. 2*a-c* show a segment of the gutter 110 near the closing organ 130, in top view (top) and longitudinal cross section (below) respectively. In the top views the grate 111 is not shown.

In FIG. 2*a* the valve 131 of the closing organ 130 is in a first stable position, in which the valve 131 seals against the seat 112 (not shown).

In FIG. 2*c* the valve 131 is in a second stable position, wherein the gutter 110 is unblocked for discharging liquid to the sewage pipe 120.

FIG. 2*b* relates to a position that is in-between the first and the second stable position. This in-between position does not have to be a stable position but for the embodiment discussed here, it is.

The valve 131 has a first side 231 which in the first stable position faces the seat and seals against it. The valve 131 has a second side 232 which in the first stable position faces away from the seat 112. This second side 232 is advantageously provided with a colour which colour, in the second position when the second side 232 is substantially parallel with the grate 111, will be visible through the grate 111. This makes its possible to perform an inspection in a simple way in order to see in which position a closing organ 130 is.

The valve 131 is rotatable around a valve axle 233. It can be seen that the valve 131 extends tangentially with respect to the axis of rotation of the valve axle 233. This allows for an effective sealing of the valve 131 against the seat 112.

FIG. 2*a-c* show frame 234 of the closing organ 130. It comprises a wall part 235 that is provided with a through opening 236. The wall part 235 will extend parallel to the platform 100 and can be loaded (walked on; driven on), i.e. it forms a supporting surface. Via this through opening 236 an operating organ 237 of an adjustment organ can be operated (discussed at FIG. 3) for bringing in the first or second position of the valve 131. The end of operating organ 237 is preferably polygonal as a result of which it can be operated using a socket spanner and preferably using an electric drill provided with a socket for changing the position of the valve 131. Thus, the operating can take place very quickly and securely. Grates 111 are in practice secured by bolts, such as bolts with a 19 mm head, and the end of the operating organ 237 has preferably the same head diameter.

FIGS. 3*a* and 3*b* show the closing organ 130 in a perspective view and in an exploded sectional view respectively.

The valve axle 233 can be obtained as an axis for a slack adjuster for a truck, for instance from Haldex AB (Landskrona, Sweden) at one end running in bearings in bearing 331, and at the other end provided with an adjustment organ 332, here in the form of a modified slack adjuster 332 (type 100001760KA, Haldex AB), of which an arm has been sawed off.

The slack adjuster 332 is attached in a known manner to the valve axle 233 using a bracket, a guiding sleeve, a key and a nut; something that needs no further elucidation. A slack adjuster 332 comprises a locking organ (in the form of two balls which are pressed outward by a spring), in the recesses of a ring. By operating the operating organ using a socket spanner or the like, the locking organs are pressed inward through the recesses, against the force exerted by the spring. This system makes it possible that maintaining a stable position does not purely depend on relatively unreliable friction.

The valve 131 comprises over at least part of the circumference thereof a sealing rubber 333, with which the valve 131 seals against the seat 112.

The frame 234 has frame through openings 334 for attaching the closing organ 130 using bolts, such as is often also done with grates 111.

The invention claimed is:

1. A method for temporarily closing off a grate-covered gutter, of a paved part of the earth's surface by means of a closing organ, said gutter being connected to a sewage pipe, characterized in that the gutter comprises a closing organ comprising a valve, which valve is fitted in the gutter rotatably about an axis of rotation of a valve axle, wherein the valve can be in a first stable position wherein the valve seals against a seat thereby closing off gravity drainage of liquid through the seat and into the sewage pipe while the sewage pipe is unfilled, and in a second stable position in which the valve releases the gutter for the discharge of liquid to the sewage pipe, wherein the closing organ further comprises an operating organ for bringing the valve from the second stable position to the first stable position by rotating the valve about the axis of rotation of the valve axle in order to counteract draining away of liquid from the gutter into the sewage pipe, and the valve is brought from the second stable position to the sealing first stable position by actuating the operating organ from above the grate-covered gutter without removing the grate, wherein the valve axle is rotatable transverse to the vertical for bringing the closing organ from the second stable position to the first stable position, wherein the valve axle is situated at a location that is away from the bottom of the gutter.

2. The method according to claim 1, wherein the operating organ comprises a transmission wherein a relatively large rotation about an operating organ axis causes a relatively small rotation of the valve around the valve axle.

3. The method according to claim 1, wherein the closing organ has a locking organ with which the valve is maintained in the second stable position before being brought to the first stable position.

4. The method according to claim 1, wherein the valve has a first side and a second side, wherein the first side in the first stable position seals against the seat and the second side is provided with a colour for being able to observe through the grate of the gutter that the closing organ is in the second position.

5. The method according to claim 1, wherein the closing organ comprises a frame, wherein the frame comprises a supporting surface that faces the sky and the valve is below the supporting surface both in the first stable position and in the second stable position.

6. The method according to claim 1, wherein contaminating liquid collected in a closed off gutter section of the gutter is pumped out of the gutter section.

7. The method according to claim 1, wherein the operating organ is actuated by rotating an end of the operating organ which end is accessible from above the grate-covered gutter without removing the grate.

8. The method according to claim 7, wherein the end of operating organ is polygonal and is rotated by using an electric drill with a socket.

9. A method for temporarily closing off a grate-covered gutter, of a paved part of the earth's surface by means of a closing organ, said gutter being connected to a sewage pipe, characterized in that the gutter comprises a closing organ comprising a valve, which valve is fitted in the gutter rotatably about an axis of rotation of a valve axle, wherein the valve can be in a first stable position wherein the valve seals against a seat thereby closing off gravity drainage of liquid through the seat and into the sewage pipe while the sewage pipe is unfilled, and in a second stable position in which the valve releases the gutter for the discharge of liquid to the sewage pipe, wherein the closing organ further comprises an operating organ for bringing the valve from the second stable position to the first stable position by rotating the valve about the axis of rotation of the valve axle in order to counteract draining away of liquid from the gutter into the sewage pipe, and the valve is brought from the second stable position to the sealing first stable position by actuating the operating organ from above the grate-covered gutter without removing the grate, wherein an end of the operating organ axis is at a distance from the bottom of the gutter, wherein the end of the operating organ is rotated through which the valve is brought from the second stable position to the first stable position.

10. The method according to claim 9, wherein the valve axle is rotatable transverse to the vertical for bringing the closing organ from the second stable position to the first stable position, wherein the valve axle is situated at a location that is away from the bottom of the gutter.

11. A method for temporarily closing off a grate-covered gutter, of a paved part of the earth's surface by means of a closing organ, said gutter being connected to a sewage pipe, characterized in that the gutter comprises a closing organ comprising a valve, which valve is fitted in the gutter rotatably about an axis of rotation of a valve axle, wherein the valve can be in a first stable position wherein the valve seals against a seat thereby closing off gravity drainage of liquid through the seat and into the sewage pipe while the sewage pipe is unfilled, and in a second stable position in which the valve releases the gutter for the discharge of liquid to the sewage pipe, wherein the closing organ further comprises an operating organ for bringing the valve from the second stable position to the first stable position by rotating the valve about the axis of rotation of the valve axle in order to counteract draining away of liquid from the gutter into the sewage pipe, and the valve is brought from the second stable position to the sealing first stable position by actuating the operating organ from above the grate-covered gutter without removing the grate, wherein the closing organ comprises a locking organ with which the valve is maintained in the second stable position before being brought to the first stable position, wherein the locking organ comprises a ring with recesses and an element that, for locking, is pressed in a recess of the ring by means of a spring and at a relative rotation of the element with respect to the ring exits the recess by pressing the spring.

12. The method according to claim 11, wherein the locking organ comprises a slack adjuster for a brake.

13. Closing organ for a gutter, characterized in that the closing organ comprises a frame, a valve and an operating organ, wherein the frame comprises a supporting surface that faces the sky in the installed state of the closing organ;

the valve is rotatable about an axis of rotation of a valve axle, wherein the valve can be in a first stable position for allowing sealing of the valve against a seat thereby closing off gravity drainage of liquid through the seat, and in a second stable position in which the valve does not seal against the seat, wherein the closing organ is arranged for bringing the valve from the second stable position to the first stable position by rotating the valve about the axis of rotation of the valve axle by actuating the operating organ from above the frame without removing the frame, wherein the operating organ comprises a rotatable end which rotatable end is accessible from above the frame without removing the frame, wherein the end rotates about an axis which is different from the axis of rotation of the valve axle.

14. Closing organ according to claim 13, wherein the closing organ comprises a seat.

15. Closing organ according to claim 13, wherein the end of operating organ is polygonal.

16. A method for temporarily closing off a grate-covered gutter, of a paved part of the earth's surface by means of a closing organ, said gutter being connected to a sewage pipe, characterized in that the gutter comprises a closing organ comprising a valve, which valve is fitted in the gutter rotatably about an axis of rotation of a valve axle, wherein the valve can be in a first stable position wherein the valve seals against a seat thereby closing off gravity drainage of liquid through the seat and into the sewage pipe while the sewage pipe is unfilled, and in a second stable position in which the valve releases the gutter for the discharge of liquid to the sewage pipe, wherein the closing organ further comprises an operating organ for bringing the valve from the second stable position to the first stable position by rotating the valve about the axis of rotation of the valve axle in order to counteract draining away of liquid from the gutter into the sewage pipe, and the valve is brought from the second stable position to the sealing first stable position by actuating the operating organ from above the grate-covered gutter without removing the grate, wherein the operating organ is actuated by rotating an end of the operating organ wherein the end is accessible from above the grate-covered gutter without removing the grate, wherein the end rotates about an axis which is different from the axis of rotation of the valve axle.

* * * * *